US005506566A

United States Patent [19]

Oldfield et al.

[11] Patent Number: 5,506,566

[45] Date of Patent: Apr. 9, 1996

[54] TAMPER DETECTABLE ELECTRONIC SECURITY PACKAGE

[75] Inventors: John A. Oldfield, Kanata; H. Charles Sabry; Adrian D. Jones, both of Ottawa, all of Canada

[73] Assignee: Northern Telecom Limited, Montreal, Canada

[21] Appl. No.: 57,390

[22] Filed: May 6, 1993

[51] Int. Cl.[6] ..... G08B 13/00

[52] U.S. Cl. ..... 340/550; 340/658

[58] Field of Search ..... 340/550, 566, 340/658, 522–554, 508; 109/41–42; 206/459.1, 807; 361/399, 415, 748

[56] References Cited

U.S. PATENT DOCUMENTS

| | | | |
|---|---|---|---|
| 4,023,156 | 5/1977 | Galvin | 340/550 |
| 4,225,859 | 9/1980 | Zetting et al. | 340/566 |
| 4,419,659 | 12/1983 | Harman et al. | 340/552 |
| 4,538,527 | 9/1985 | Kitchen | 340/550 X |
| 4,777,476 | 10/1988 | Dank | 340/550 X |
| 4,884,061 | 11/1989 | Genevois | 340/550 |
| 5,285,734 | 2/1994 | MacPherson | 109/42 |

OTHER PUBLICATIONS

Wiengart, S. H. "Physical Security for the uABYSS System", from Proceedings of the IEEE Symposium on Security and Privacy, Apr. 27–29, 1987, Oakland, California, pp. 52–58.

Chaum, D. "Design Concepts for Tamper Responding Systems", Advances in Cryptology, Proceedings of Crypto '83, Plenum Press 1984, pp. 387–392.

*Primary Examiner*—Thomas Mullen

*Attorney, Agent, or Firm*—J. E. Moorhouse

[57] ABSTRACT

An intrusion detection electronic circuit package, includes a containment wall in combination with first and second transmission lines being organized in patterns spaced adjacent one another. Electronic circuitry, residing within the containment wall, includes a transmitter for transmitting signals in anti-phase relationship via the first and second transmission lines respectively. A receiver receives signals from the transmission lines and a detector connected to the receiver uses EXCLUSIVE OR logic to detect any significant in-phase components or interruptions in the signals received at the first and second inputs of the receiver. Disturbance of either transmission line in any attempt to breach the containment wall is likely to be detected.

18 Claims, 6 Drawing Sheets

TAMPER DETECTABLE ELECTRONIC SECURITY PACKAGE

The invention is in the field of electronic apparatus and relates to a security package in which an attempt to break into the package or otherwise gain access to the contents of the security package is intended to be electrically detected.

BACKGROUND OF THE INVENTION

Critical electronic circuitry, from a security viewpoint, is that which is susceptible to eavesdropping or otherwise may be altered or disabled without the knowledge of a subscriber or owner of a system or apparatus having such circuitry. For example, such electronic circuitry may be that used for encrypting or decrypting communications signals, or for electronic control circuitry in remote automated financial service terminals. The likelihood of illegal access to, or tampering with, any such circuitry is directly proportional to the profit which may be accrued by the tamperer, and inversely proportional to the degree of difficulty expected by the potential tamperer.

Two basic approaches have been used in the provision of security packages. One has been to provide a housing sufficiently impenetrable so that application of sufficient force to breach the wall of the housing will likely result in the contents being rendered valueless or alternatively will be prohibitively expensive or time consuming. Another approach has been to sensitise the housing by some means such that an occurrence of tampering is readily detected, whereby appropriate subsequent action may be effected.

In examples of the later approach, the wall of a housing includes one or more electrical conductors which may be monitored for continuity. In one example, the breaking of any one conductor results in a loss of continuity, which may be evidence of tampering. However in this example, the appropriate electrical conductor may be bridged with another conductor being placed by the tamperer, prior to the breakage, in order to conceal the occurrence of tampering.

In another more sophisticated example, one or more electrical conductors are arranged to be of a convenient predetermined resistance or may include segments of predetermined resistances. Tamper detection circuitry includes resistance measurement means which is adjusted at the time of manufacture to have an all seems well range. During use, if the resistance of a monitored electrical conductor changes to a value outside of the all seems well range, this is taken to be an indication of possible tampering. Unless the tamperer has acquired a very detailed knowledge of the particular package to which access is desired, any attempted tampering will very likely be detected. Although this example of tamper detection is more difficult to circumvent than the preceding example, manufacture of this form of security packaged electronic circuitry requires expensive individual attention to adjustments of the all seems well range for each conductor, in order to optimize tampering detection performance and yet provide for long term reliability, by minimizing effects of aging, and environmental variations, as well as power fluctuations, any of which may cause false alarms.

It is an object of the invention to provide a security package having a housing wall including at least two electrical conductors with a more reliable detection apparatus and method for detecting an occurrence of tampering.

SUMMARY OF THE INVENTION

An intrusion detection electronic circuit package, in accordance with the invention, includes a containment wall in combination with first and second transmission lines being organized in patterns spaced adjacent one another. Electronic circuitry, residing within the containment wall, includes a transmitter for transmitting signals in anti-phase relationship via first and second outputs connected to the first and second transmission lines respectively, a receiver with first and second inputs connected to the first and second transmission lines respectively for receiving signals therefrom, and a detector connected to the receiver, for detecting in-phase components in signals received at the first and second inputs of the receiver. Detection of any in-phase component or an interruption in the anti-phase signals is an indication of tampering.

An apparatus in accordance with the foregoing description will detect an antiphase variance in the transmission of the drive signals as may occur by the severing, grounding, and/or jumpering of either of the transmission lines as would be likely with any physical attempt to breach the containment wall.

A method, in accordance with the invention, for detecting an incidence of possible intrusion at a barrier which includes a pair of electrical conductors extending throughout the barrier, includes the steps of:

a) transmitting symmetrical electrical signals in antiphase relationship, from a first position along each of the electrical conductors;

b) at a second position along each of the electrical conductors, detecting any electrical state which is other than signals in said antiphase relationship; and c) latching a tamper signal, in response to a detecting occurrence in step b), extending beyond a predetermined period of time.

In one example in accordance with the invention, an intrusion detection electronic circuit package includes a containment wall of electrically insulating material in combination with first and second transmission lines, each transmission line consisting of an electrically conductive path carried by the containment wall and being arranged in substantially meandering patterns spaced adjacent one another; an oscillator for generating pulse signals at a fundamental frequency within an audible spectrum of frequencies; a driver means being responsive to the pulse signals for transmitting first and second signals in anti-phase relationship via the first and second transmission lines; first and second terminating means connected to the first and second transmission lines remote from the driver circuit means; first and second amplifiers having inputs connected with the first and second terminating means respectively, the first and second amplifiers being operable for limiting signals received via the first and second transmission lines from the driver circuit means; a latch means being responsive to an occurrence of a set signal to be in a set state, and in the absence of a set signal being responsive to an occurrence of a clear signal in an alternate state; an EXCLUSIVE OR logic circuit having inputs coupled to receive signals from the first and second amplifiers, and an output, the EXCLUSIVE OR logic circuit being responsive to an anti-phase asymmetry in the signals from the receiver by asserting the set signal at its output; and means connected to the output of the EXCLUSIVE OR logic circuit, for negative the response of the latch means to set signal occurrences of less than a predetermined duration; whereby setting of the latch circuit is an indication that tampering with the intrusion detection electronic circuit package may have occurred.

BRIEF DESCRIPTION OF THE DRAWINGS

An example embodiment is discussed with reference to the accompanying drawings in which.

DETAILED DESCRIPTION

Figure 1:
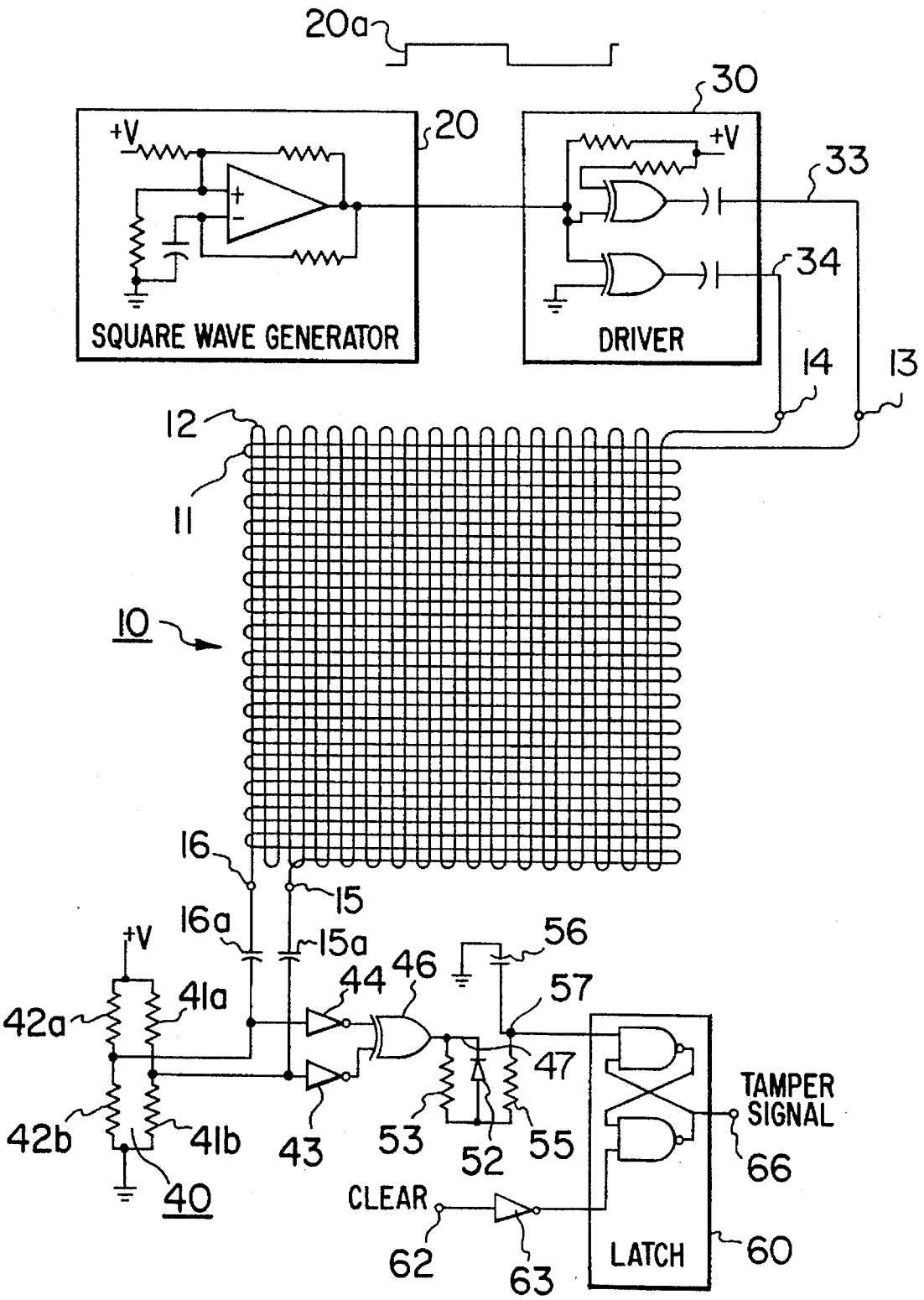
FIG. 1 is an electrical schematic diagram of an electronic circuit for providing a tamper detectable package in accordance with the invention.

The electronic circuit in FIG. 1 includes a barrier or containment wall generally depicted at 10 to have a pair of conductors or transmission lines, 11 and 12, being arranged in rows and columns. The transmission lines are each provided by a thin filament of copper wire or other suitable conductor, being insulated one from the other, but otherwise in close relationship one with the other, and embedded within the containment wall or carried on a surface (not shown) of the containment wall 10. The transmission line 11 includes an input terminal 13 and an output terminal 15. The transmission line 12 includes an input terminal 14 and an output terminal 16. A square wave generator 20 is operated to provide a square wave signal 20*a*, of about 2 KHz, to a driver circuit 30. The driver circuit 30 includes first and second a.c. outputs 33 and 34 connected to the input terminals 13 and 14. The driver circuit 30 is responsive to the square wave signal by driving the transmission line 11, via the input terminal 13, with a corresponding square wave signal, and by driving the transmission line 12, via the input terminal 14, with a square wave signal in antiphase relationship with the square wave signal at the input terminal 13. A resistor network 40 includes first and second pairs of resistors 41*a* and 41*b* and 42*a* and 42*b*. The pairs of resistors are arranged in series between ground and +V d.c. potentials and connected as shown to provide direct current resistance terminations. Preferably, the resistors 41*a* and 42*a* are of about 20% to 30% lesser ohmic value than the resistors 41*b* and 42*b* so that the inputs of buffer amplifiers 43 and 44 are biased more toward the +V than ground. In this example, the buffer amplifers 43 and 44 were provided by type 74HC14 Schmitt inverters. The output terminals 15 and 16 are coupled via capacitors 15*a* and 16*a* to a detector circuit which includes the buffer amplifiers 43 and 44, which operate as limiters to provide square wave signals at the inputs of an EXCLUSIVE OR gate 46. An output 47 of the EXCLUSIVE OR gate 46 is coupled via a filter to an input of a latch circuit 60, so that transient perturbations or small glitches in antiphase symmetry of signals appearing at the output terminals 15 and 16 will not be passed onto the latch circuit 60. The anode of a diode 52 is connected to the output 47 and a resistor 53 is connected in parallel with the diode 52 to provide a fast discharge, slow recharge path for an RC network of a resistor 55 and a capacitor 56. A junction 57 of the resistor 55 and the capacitor 56 is connected to the input of the latch circuit 60. An output of the latch circuit 60 is connected to a terminal 66 at which a tamper signal is latched-low to indicate that tampering may have or is occurring. In an event of an assertion of a clear signal at a terminal 62, the latch circuit may be reset, or cleared via an inverter 63, if signals at the output terminals 15 and 16 regain antiphase symmetry.

Figure 1A:
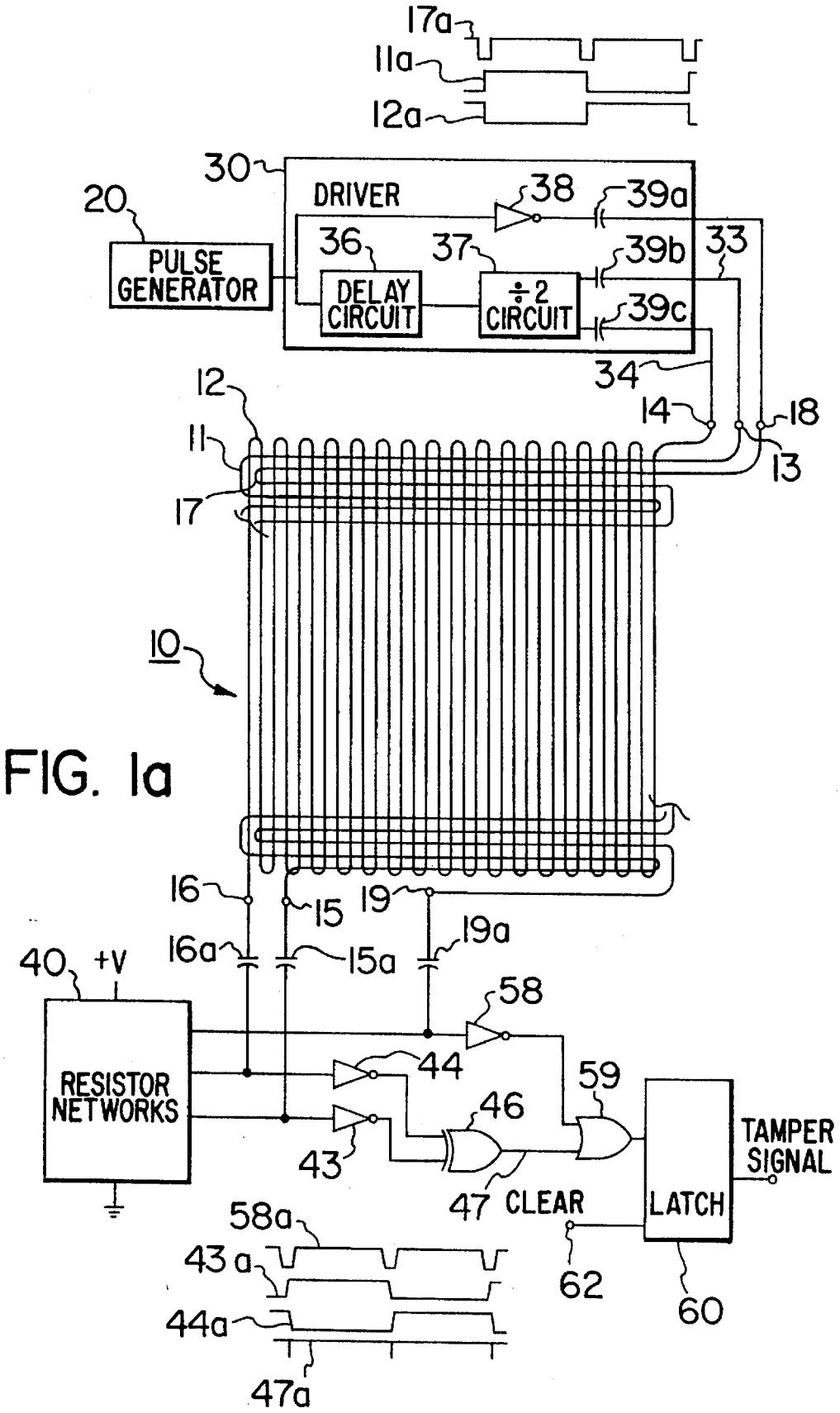
FIG. 1*a* is an electrical schematic diagram of an alternate embodiment of the electronic circuit illustrated in FIG. 1.

In FIG. 1*a*, elements which are the same as, or similar to, the elements in FIG. 1 are identified by the same or similar labels. A pulse generator 20 provides pulse signals at a 4 KHz rate. The 4 KHz pulse signals are produced with about a 10% duty cycle for operating the driver circuit 30. The drive circuit in this example includes a delay circuit 36, a divide by two flip flop circuit 37 and an inverter 38. The inverter 38 generates an inverted form of the 4 KHz pulse signals as illustrated by a wave form 17*a*. The delay circuit 36, and the divide by two circuit 37 are responsive to the 4 KHz pulse signals for driving the transmission line 11, via the input terminal 13, with a 2 KHz square wave signal 11*a*, and by driving the transmission line 12, via the input terminal 14, with a square wave signal 12*a* in antiphase relationship with the 2 KHz square wave signal 11*a*. The delay circuit 36 passes the pulse signals to the divide by 2 flip flop circuit 37 with about 10 to 15 micro-seconds of delay. The divide by 2 flip flop circuit 37 drives the transmission lines 11 and 12. One feature of this example is that of controlling the effective sensitivity of the detector circuit with a blanking signal, instead of filtering the detected signal as in the preceding example. The pulse signals, as shown at 58*a*, drive another inverter 58, which provides the blanking signals. In this example the inverters 43 and 44 are driven by signals 43*a* and 44*a* which having traversed the transmission lines 11 and 12 and are received via the terminals 15 and 16. The signals 43*a* and 44*a* are illustrated as being in a slightly skewed relationship, as might occur in normal operation. The EXCLUSIVE OR gate 46 detecting this misalignment generates brief signal assertions at its output 47, which are illustrated in a wave form 47*a*. These brief signal assertions would be sufficient to set the latch circuit 60 were it not for the blanking signal applied to the OR gate 59 from the inverter 58. The blanking signal 58*a* negates the effect of any signal assertion that may occurred while the blanking signal is present. Otherwise if either of the signals 43*a*and 44*a*, or are interrupted for even a moment, the latch circuit 60 is set and a tampering event is indicated by assertion of the tamper signal.

In the example shown in FIG. 1*a*, the containment wall 10 includes an additional transmission line 17 which is illustrated as lying parallel with the transmission line 11 and extending between an input terminal 18 and an output terminal 19. For purposes of direct current isolation and detection, the input terminals 18, 13, and 14 are coupled via capacitors 39*a*, 39*b*, and 39*c*. Likewise the output terminals 15, 16, and 19 are coupled via capacitors 15*a*, 16*a*, and 19*a*. The signals at these terminals are direct current restored by the resistor network 40 in a manner similar to that described in relation to FIG. 1. Although there may be some operational advantages to having the transmission line 17 included in the containment wall 10, it is not essential, and it may be convenient or advantageous to connect the output of the pulse generator 20 directly to the input of the OR gate 59.

Figure 2:
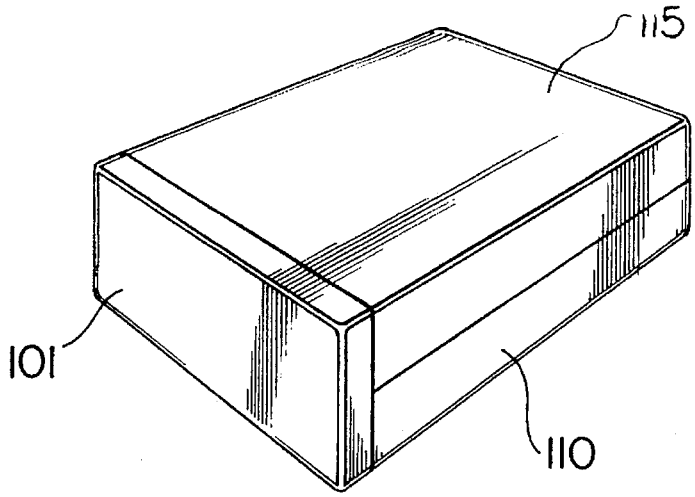
FIG. 2 is a perspective exterior view of a tamper detectable package diagram of one example of a tamper detectable electronic security package, which includes the electronic circuitry of FIG. 1, and wherein security sensitive electronic apparatus may be contained in accordance with the invention.

The tamper detectable electronic security package illustrated in FIG. 2, primarily consists of three metallic castings, a main housing 110 and an exterior lid 115 which together carry a front bezel 101. The front bezel 101 may provide mounting positions for indicators and control buttons, not shown. This package provides a secure cavity at some distance behind the front bezel 101, between the main housing 110 and the exterior lid 115, as is illustrated in more detail in FIG. 3. The metallic castings 101, 110, and 115 are assembled together with screw fasteners or any convenient means (not shown) with no precaution to impede or discourage disassembly.

Figure 3:
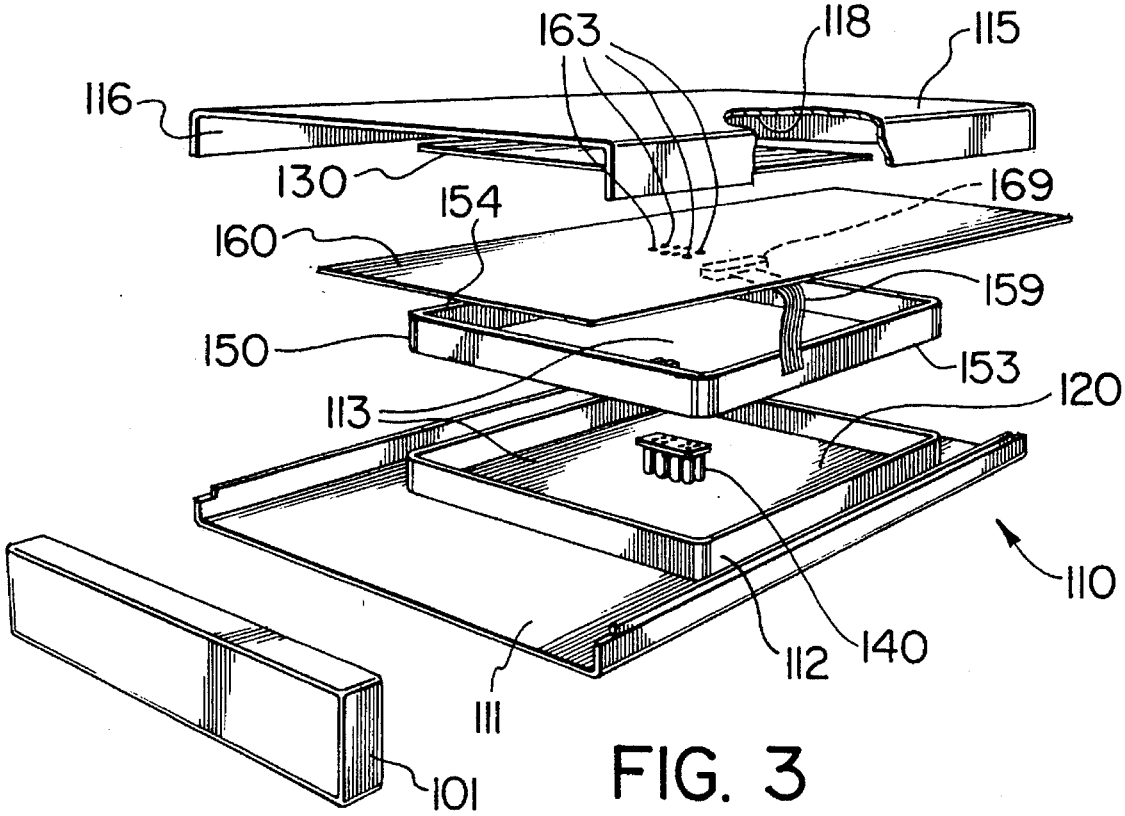
FIG. 3 is an exploded perspective view of the tamper detectable package shown in FIG. 2.
Figure 4:
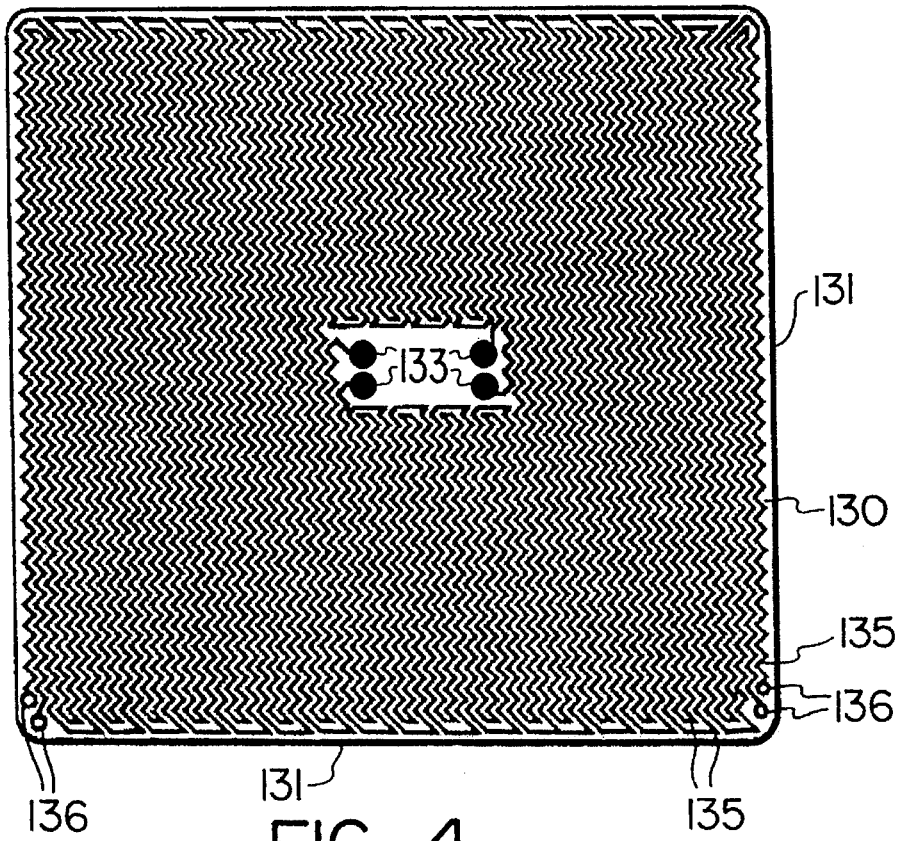
FIGS. 4 and 5 are plan views of ridged barrier circuit boards used in the tamper detectable package illustrated in FIGS. 2 and 3.
Figure 5:
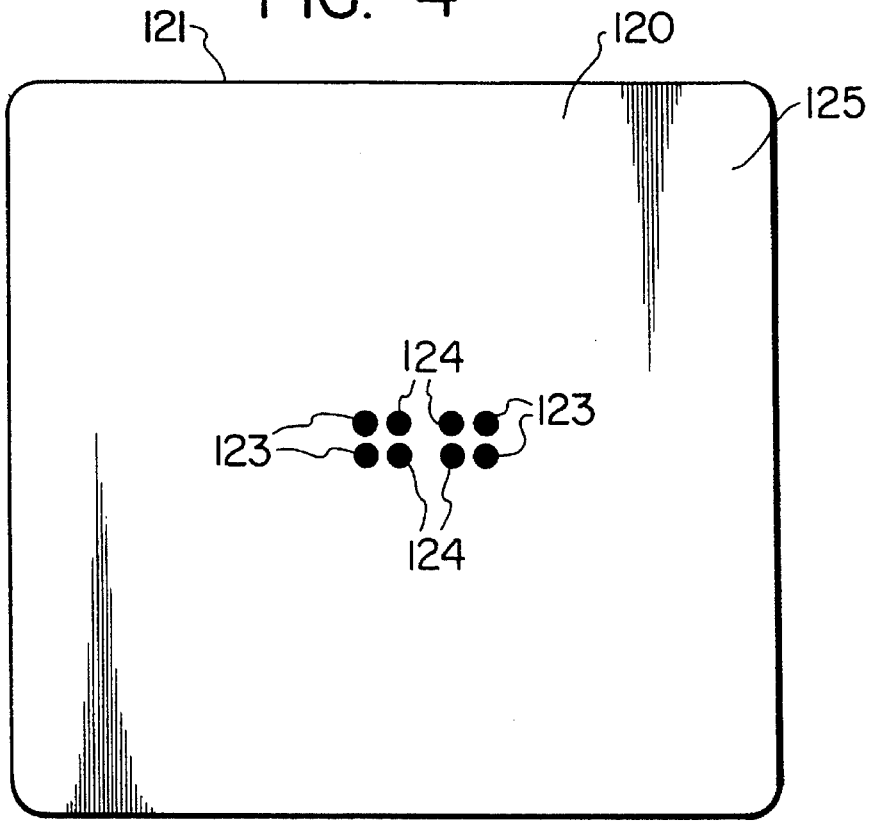

Referring to FIG. 3, the front bezel 101, the main housing 110 and the exterior lid 115 are illustrated as being separated in a perspective exploded view to reveal the interior of the tamper detectable package. The main housing 110 includes a floor portion 111 above which a continuous wall 112 rises to a uniform height to define a rectangular cavity. An inner chassis 116 is fixed inside the exterior lid 115. A first containment or barrier wall 120 is provided by a printed circuit board having a peripheral edge 121 and four pairs of contact lands 123 and 124 as shown in FIG. 5. The printed circuit board lies against the floor 111 with its edge 121 positioned closely adjacent the wall 112 and the contact lands 123 and 124 facing toward the inner chassis 116. A second containment wall 150 is of a form similar to that of the continuous wall 112, but of slightly lesser dimensions so that in assembly it is loosely contained within the continuous wall 112, with edges 153 and 154, in assembly with the edge 153 abutting the surface of the first containment wall 120. In combination, the first and second containment walls 120 and 150 provide five sides of a secure cavity 113. A third containment wall 130 is provided by a printed circuit board having a peripheral edge 131 and contact lands 133 as shown in FIG. 4. The printed circuit board is shown removed from an inner surface 118 of the inner chassis 116 however in assembly it is normally fixed against the inner surface 118. In assembly, the third containment wall 130 provides a sixth and closing side of the secure cavity 113. A printed circuit board carrying security sensitive circuitry, hereafter referred to as an encryption unit 160, is positioned between the second and third containment walls 150 and 130, such that in assembly the encryption unit 160 extends across and protrudes beyond the secure cavity 113. Some resilient gasket material may be placed between the encryption unit 160 and the third containment wall 130, to provide a stand off cushion when the main housing 110 and the exterior lid 115 are assembled together as illustrated in FIG. 2. In assembly, components of the encryption unit 160, for example controllers, memories, and ancillary logic chips, protrude downwardly into the volume of the secure cavity, as exemplified by a ribbon cable connector 169. The ribbon cable connector 169 is illustrated in broken outline to indicate that it is hidden from view. The ribbon cable connector 169 provides for connection of the encryption unit 160 with electrical conductors of the second containment wall 150 via a ribbon cable 159. The encryption unit 160 includes the electronic circuit, not shown, for providing the tamper detectable package.

In FIG. 4, the third containment wall 130 is shown to be a rectangular printed circuit board with zigzag patterned conductors 135 in substantially parallel arrangements being joined at the ends thereof to provide parts of the schematically illustrated first and second transmission lines 11 and 12. The printed circuit board includes two pairs of electrically conductive contact lands 133 arranged to provide input and output connections with the zigzag patterned conductors 135. A similar pattern of conductors is carried on the rear side of the containment wall 130, however, this pattern does not include any contact lands. Plated through-holes 136 provide connections between the conductors on the opposite sides of the containment wall.

In FIG. 5, the first containment wall 120 is shown to be a rectangular board. Although a conductor pattern 125 is not shown for convenience of illustration, the board is similar to that shown in FIG. 4, with the exception that it includes four pairs of electrically conductive contact lands 123 and 124.

Figure 6:
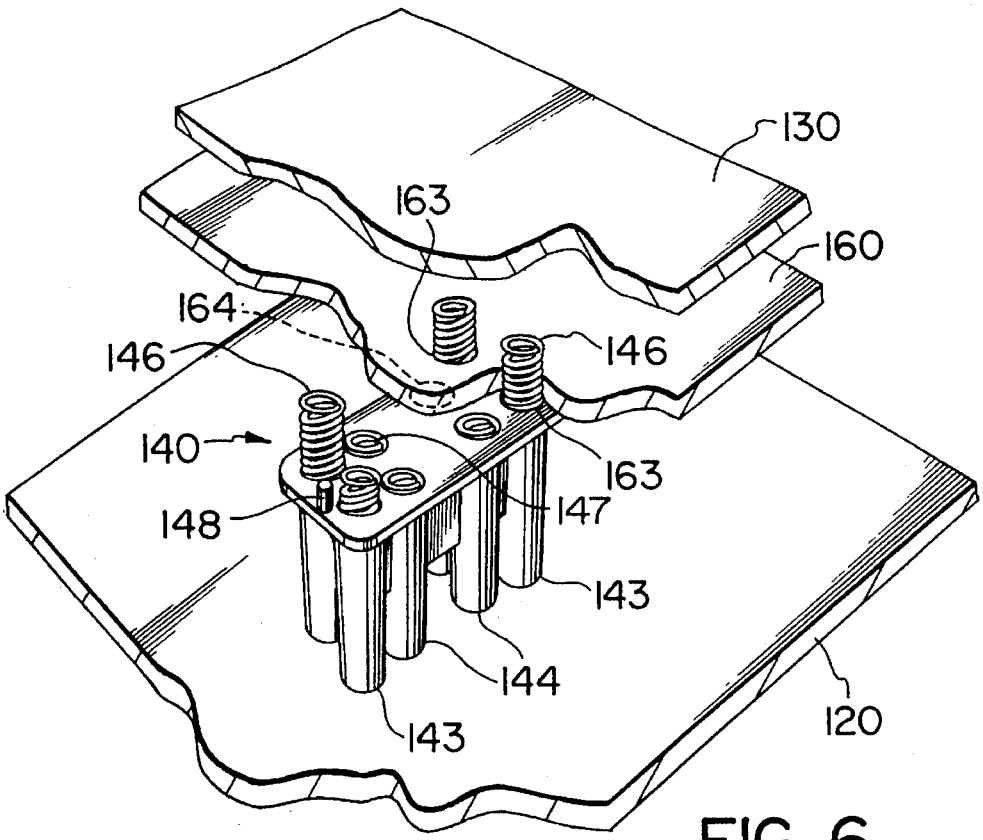
FIG. 6 is an exploded partial perspective view showing one aspect of the tamper detectable package illustrated in FIG. 3.
Figure 7A:
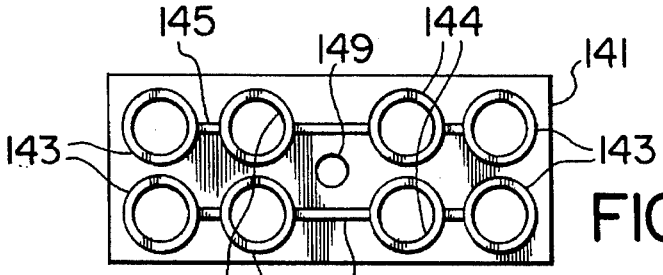
FIGS. 7*a*, 7*b*, and 7*c* are plan, side, and end views of a contact holder used in the tamper detectable package illustrated in FIGS. 3 and 6.
Figure 7B:
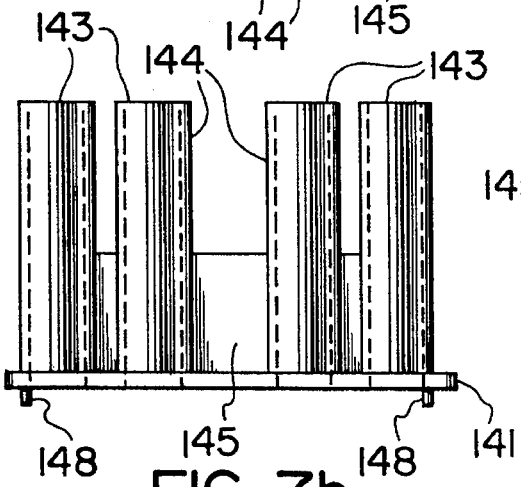
Figure 7C:
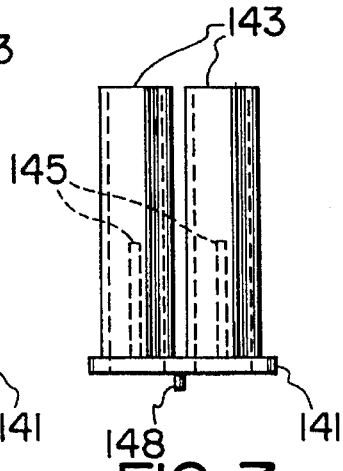

In FIG. 6, the arrangement of the first and third containment walls 120 and 130 is shown to be on either side of the encryption unit 160. A connector and land areas carried by the encryption unit, and the first and third containment walls cooperate in assembly to provide electrical connections to effect the tamper detectable package, as is described in more detail in the following. A connector body 140 in assembly is fastened to the underside of the encryption unit 160 such that it is interposed between the encryption unit 160 and the first containment wall 120. As illustrated in FIGS. 7*a*, 7*b*, and 7*c*, the connector body 140 includes a base 141 through which two pairs of hollow cylinders 143 and two pairs of hollow cylinders 144 extend in a direction normal to the base. Webs 145 extend between the cylinders and the base as shown. Protrusions 148 extend from the base, as shown, and cooperate with corresponding receptacles, not shown, in the encryption unit 160 to position the connector body 140 for fastening thereto via an opening 149 in the base 141. As shown in FIG. 6, the encryption unit 160 includes four openings 163, two of which are shown, in its circuit board. In assembly, spring members 146 are retained within the cylinders 143 to provide resilient electrical connections between the lands 123 and the lands 133, carried by the first and third containment walls 120 and 130. In a similar manner, the cylinders 144 retain spring members 147 to provide resilient electrical connections between the lands 124 and the corresponding lands 164 (one shown in dotted outline) on the underside of the circuit board of the encryption unit 160.

Figure 8:
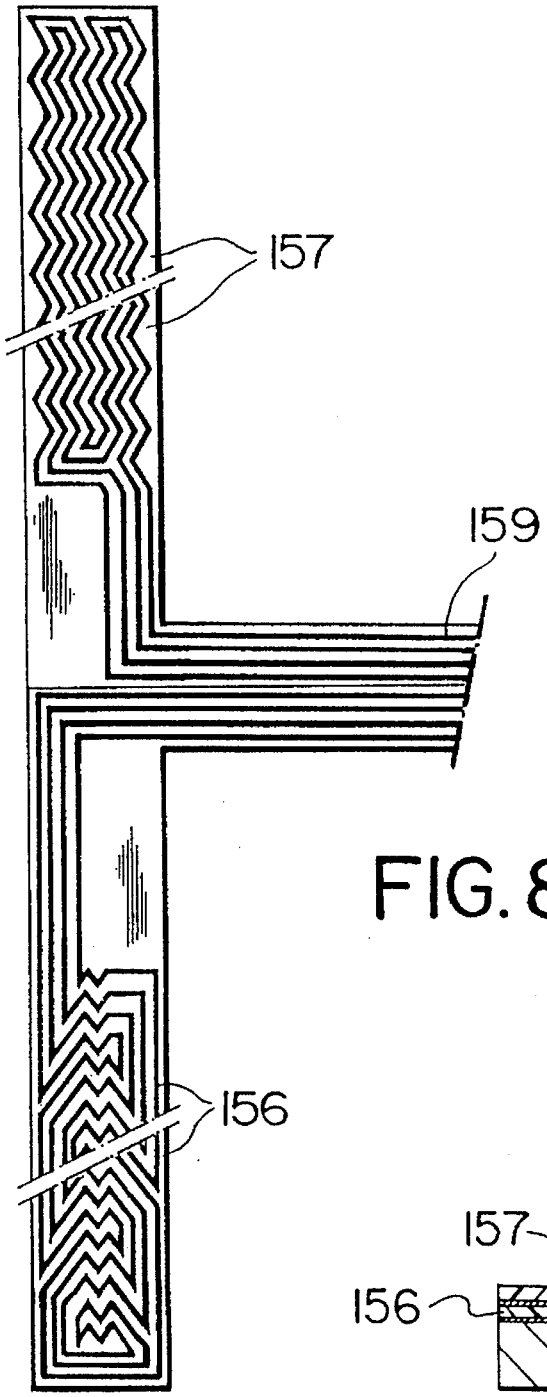
FIG. 8 is a broken plan view of a flexible barrier circuit board used in the tamper detectable package illustrated in FIGS. 2 and 3.
Figure 8A:
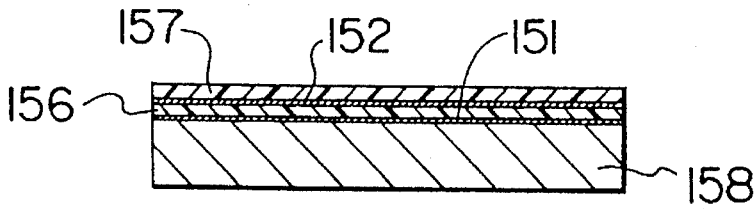
FIG. 8*a* is a partial sectional view taken along one of the break lines in FIG. 8.

Details as to the structure of transmission lines 11 and 12, as provided within the second containment wall 150, are shown in FIGS. 8 and 8*a*. As before illustrated in FIG. 3, the second containment wall 150 is a continuous band of any convenient material of slightly lesser dimensions than the dimensions of the wall 112. One convenient material is steel sheet, labelled 158 in FIG. 8*a*. An outer periphery of the steel sheet 158 carries first and second flexible printed circuits 156 and 157. The first flexible printed circuit 156 is adhesively bound by an adhesive layer 151 to the steel sheet 150, and the second flexible printed circuit 157 is adhesively bound by an adhesive layer 152 to the first flexible printed circuit 156. Conductors of both the transmission lines 11 and 12 traverse these flexible circuit carriers originating and terminating at the ribbon cable 159, partially shown.

As will be appreciated by those acquainted with the electronic arts, the foregoing description is directed toward providing a secure cavity of modest dimensions, suitable for containing a circuit board such that in the event of tampering, such is detected, thus providing an opportunity for an appropriate immediate response. It is envisaged that the barrier may well be incorporated directly into a multilayer printed circuit board, or into the encapsulation container of an integrated circuit. Also, it may be advantageous to provide for one or more of the transmission lines in the containment wall by means of an optical conductor. It is also believed that volumes, ranging in size from integrated circuits to cellular phones to safety deposit boxes to portions of buildings, may be provided with improved security in view of the principles as hereinbefore exemplified. Various other examples of containment cavities, within the spirit of the invention and in accordance with the appended claims, will without doubt come to the minds of persons having read the foregoing description.

We claim:

1. An intrusion detection electronic circuit comprising:

a containment wall in combination with first and second transmission lines, the first and second transmission lines being spaced adjacent one another throughout the containment wall;

a transmitter having first and second outputs connected to the first and second transmission lines respectively, for transmitting signals in antiphase relationship one with the other;

a receiver including first and second inputs, connected to the first and second transmission lines respectively for receiving signals therefrom; and a detector, for detecting an in phase component in signals received at the first and second inputs.

2. An intrusion detection electronic circuit as defined in claim 1, wherein the first and second transmission lines are arranged with the first-overlying the second.

3. An intrusion detection electronic circuit as defined in claim 1, wherein the first and second transmission lines are arranged in combination to resemble a screen.

4. An intrusion detection electronic circuit as defined in claim 1, wherein portions of the first and second transmission lines are arranged substantially in parallel one with the other.

5. An intrusion detection electronic circuit as defined in claim 1, wherein portions of the first and second transmission lines are arranged substantially in parallel one with the other in a zigzag pattern.

6. An intrusion detection electronic circuit as defined in claim 1, wherein the containment wall contains a plurality of layers of the transmission lines.

7. An intrusion detection electronic circuit as defined in claim 1, wherein the containment wall comprises an electrically insulating material and each transmission line consists of an electrically conductive path carried by the containment wall.

8. An intrusion detection electronic circuit as defined in claim 1, wherein a cavity is defined within a plurality of the containment walls.

9. An intrusion detection electronic circuit as defined in claim 8, wherein the cavity contains said transmitter, said receiver and said detector.

10. An intrusion detection electronic circuit as defined in claim 1, wherein the transmitter includes a square wave generator and a digital driver circuit connected to the first and second outputs and being responsive to signals from the square wave generator for providing signals in antiphase relationship at the first and second outputs.

11. An intrusion detection electronic circuit as defined in claim 1, wherein the receiver includes first and second voltage dividers having first and second voltage taps capacitively connected to the first and second inputs in common with inputs of first and second amplifiers respectively, the first amplifier for generating amplitude limited signals in response to signals appearing at the first voltage tap, and the second amplifier for generating amplitude limited signals in response to signals appearing at the second voltage tap.

12. An intrusion detection circuit as defined in claim 11, wherein the first and second amplifiers are Schmitt amplifiers.

13. An intrusion detection electronic circuit as defined in claim 11, wherein the detector includes an EXCLUSIVE OR logic circuit having an output coupled to a latch circuit, the EXCLUSIVE OR logic circuit being responsive to any antiphase asymmetry in the limited signals by asserting a signal for setting the latch circuit.

14. An intrusion detection electronic circuit comprising:

a containment wall of electrically insulating material in combination with first and second transmission lines, the transmission lines consisting of first and second electrically conductive paths, respectively, carried by the containment wall, the first and second conductive paths being arranged adjacent one another to resemble a screen;

a square wave generator and a driver circuit being responsive to signals from the square wave generator for transmitting first and second signals in antiphase relationship through the first and second transmission lines, respectively;

an EXCLUSIVE OR logic circuit having inputs coupled to receive signals from the transmission lines and an output coupled to a latch circuit, the EXCLUSIVE OR logic circuit being responsive to any antiphase asymmetry in the signals from the transmission lines by asserting a signal for setting the latch circuit.

15. An intrusion detection electronic circuit comprising:

a containment wall of electrically insulating material in combination with first and second transmission lines, the first and second transmission lines including first and second electrically conductive paths respectively, being carried adjacent one another by the containment wall;

an oscillator for generating pulse signals at a fundamental frequency within an audible spectrum of frequencies;

a driver circuit means being responsive to the pulse signals for transmitting first and second signals in antiphase relationship through the first and second transmission lines, respectively;

first and second terminating means connected to the first and second transmission lines remote from the driver circuit means;

first and second amplifiers having inputs connected with the first and second terminating means respectively, the first amplifier for generating amplitude limited signals in response to signals appearing at the first terminating means, and the second amplifier for generating amplitude limited signals in response to signals appearing at the second terminating means;

a latch means being responsive to an occurrence of a set signal to be in a set state, and in the absence of a set signal being responsive to an occurrence of a clear signal to be in an alternate state;

an EXCLUSIVE OR logic circuit having inputs coupled to receive signals from the first and second amplifiers, and an output, the EXCLUSIVE OR logic circuit being responsive to any antiphase asymmetry in the limited signals by asserting the set signal at its output; and a low pass filter means connected between the output of the EXCLUSIVE OR logic circuit and an input of the latch means.

16. An intrusion detection electronic circuit comprising:

a containment wall of electrically insulating material in combination with first and second transmission lines, the first and second transmission lines including first and second electrically conductive paths, respectively, being carried adjacent one another by the containment wall;

an oscillator for generating pulse signals at a fundamental frequency within an audible spectrum of frequencies;

a driver circuit means being responsive to the pulse signals for transmitting first and second signals in antiphase relationship through the first and second transmission lines, respectively;

first and second terminating means connected to the first and second transmission lines remote from the driver circuit means;

first and second amplifiers having inputs connected with the first and second terminating means respectively, the first and second amplifiers for generating amplitude limited signals in response to signals at the first and second terminating means;

a latch means being responsive to an occurrence of a set signal to be in a set state, and in the absence of a set signal being responsive to an occurrence of a clear signal to be in an alternate state;

an EXCLUSIVE OR logic circuit having inputs coupled to receive signals from the first and second amplifiers, and an output, the EXCLUSIVE OR logic circuit being responsive to any antiphase asymmetry in the amplitude limited signals by asserting the set signal at its output; and a blanking means for negating each assertion of the set signal for a predetermined duration of time.

17. A method for detecting an incidence of tampering at a barrier which includes a pair of electrical conductors extending throughout the barrier, the method comprising the steps of:

a) transmitting first and second electrical signals in a symmetrical antiphase relationship from a first position through respective ones of the pair of electrical conductors;

b) at a second position remote from the first position along the pair of electrical conductors detecting a phase relationship between said first and second electrical signals which is other than an antiphase relationship; and c) in response to a detecting occurrence in step b) extending beyond a predetermined period of time, latching a tamper signal as an indication of tampering.

18. A method for detecting an incidence of intrusion as defined in claim 17, wherein the signals transmitted in symmetrical antiphase relationship are square waves and the wherein step b)is performed by EXCLUSIVE ORING said first and second electrical signals.

* * * * *